US005881487A

United States Patent [19]

Chalker

[11] Patent Number: 5,881,487

[45] Date of Patent: Mar. 16, 1999

[54] MULTI-PURPOSE, MULTI-WEAPON TACTICAL SLING/HARNESS

[76] Inventor: Dennis Chalker, 1759 Royston Dr., San Diego, Calif. 92154

[21] Appl. No.: 128,111

[22] Filed: Aug. 3, 1998

Related U.S. Application Data

[60] Provisional application No. 60/060,773, Oct. 3, 1997.

[51] Int. Cl. [6] ..... F41C 23/02

[52] U.S. Cl. ..... 42/85; 42/94

[58] Field of Search ..... 42/85, 94; 224/150

[56] References Cited

U.S. PATENT DOCUMENTS

| | | | |
|---|---|---|---|
| 3,258,182 | 6/1966 | McDonald | 224/1 |
| 3,430,828 | 3/1969 | Gregson | 224/1 |
| 3,501,074 | 3/1970 | Emerick | 224/1 |
| 3,869,074 | 3/1975 | Roach | 224/1 R |
| 4,964,553 | 10/1990 | Glynn | 224/149 |
| 5,325,618 | 7/1994 | Turner | 42/85 |
| 5,642,584 | 7/1997 | Riggenbach | 42/85 |
| 5,642,847 | 7/1997 | DeMeo et al. | 224/623 |
| 5,669,170 | 9/1997 | Norris | 42/85 |

*Primary Examiner*—Charles T. Jordan
*Assistant Examiner*—Meena Chelliah
*Attorney, Agent, or Firm*—Frank D. Gilliam

[57] ABSTRACT

A sling for a tactical weapon that at least partially surrounds the body of a human, has shoulder straps with adjustable shoulder pads, a resilient back strap in one embodiment and no back strap in another embodiment. The front waste band has a buckle for waste band central detachment in one embodiment and is has no central detachment in another embodiment. One embodiment has the back straps crossed and attached together at the cross over with side waste band buckles on each end thereof with length adjustable straps passing through the buckles with the opposite end attached to rings on the front waste strap.

19 Claims, 2 Drawing Sheets

MULTI-PURPOSE, MULTI-WEAPON TACTICAL SLING/HARNESS

This application claims the benefit of U.S. Provisional application No. 60/060,773, filed Oct. 3, 1997.

BACKGROUND OF THE INVENTION

The invention is directed to slings for supporting long guns and more particularly for the support of tactical weapons for individuals wearing body armor.

U.S. Pat. No. 5,669,170 by inventor Terry Bruce Norris teaches a long gun sling with one shoulder strap and a waist belt with a two length adjustable buckles. Gun mounting straps spaced apart and fixedly attached to the shoulder strap. Each of the mounting straps have a buckle connector for interconnecting the ends together. The long gun cannot be utilized while attached to the sling.

U.S. Pat. No. 5,642,847 by inventor Lttillo Alexander DeMeo et al. teaches a firearm support having a waist and an under the arm strap or belt surrounding the body of the wearer. The firearm cannot be utilized while attached to the support.

U.S. Pat. No. 4,964,553 by inventor Donald J. Glynn teaches a holster member for receiving the butt end of the long gun and is supported by a waist belt. A full and a partial shoulder strap. The partial strap is connected to the full strap intermediate its ends. Both ends of the two shoulder straps are fixedly attached to the waist belt at one end and a distal end of the full strap is removably attached to the waist belt and is removable to support on end of the long gun.

U.S. Pat. No. 3,869,074 by inventor Raymond F. Roach teaches a shotgun/rifle holder having a waist strap buckle length adjustable and a shoulder strap. A gun butt holder is suspended from the belt by a chain and the forestock or barrel is held to the shoulder strap by means of a clip adjustably attached thereto. There is no teaching for firing the shotgun/rifle from a holder attached position.

U.S. Pat. No. 3,430,828 by inventor M. R. Gregson teaches a gun sling that is shoulder supported with a loose strap removably attached to the gun butt via a butt case. The gun is attached to the loose strap by a short flexible line with a snap fastener interconnecting the line with the loose strap. A belt buckle secures the loose strap through the snap fastener.

U.S. Pat. No. 3,501,074 by inventor R. D. Emerick teaches a gun carrier with a trough like cradle for holding a rifle or shotgun and means for holding the gun in the trough. The gun can be readily released from the cradle.

U.S. Pat. No. 3,258,182 by inventor M. H. McDonald teaches a combination gun carrying harness and a flexible sling for carrying sporting firearms.

The drawbacks of the above patented slings are that they do not allow the weapon to be both supported and fired while attached to the sling or quickly disconnected from the sling as maybe required by the user.

There is as continuing need for an improved tactile weapon sling that enables the user to support the weapon from the shoulders when not in use, shoot the weapon in any firing position while attached to the sling or quickly release the weapon from the sling as desired.

SUMMARY OF THE INVENTION

In a first embodiment the invention provides a sling for a tactile weapon that eliminates many problems associated with prior art over the shoulder slings. The sling of the invention has a chest strap attached to a shoulder harness. A snap shackle is attached to the center piece between the shoulder straps of the shoulder harness and allows for rapid hookup or release of a weapon from the sling of virtually any shotgun, carbine, subgun, rifle, entry weapon or the like. The sling of the invention allows for a fast weapon shoulder position for firing as well as COB (define) techniques and hip mount entry positions.

The sling harness is designed to spread the weapon weight over the shoulders and back of the wearer eliminating discomfort associated with wearing a sling for weapon support an extended length of time. The sling of the invention can be worn over or under body armor, is ambidextrous and does not interfere with the wearing of a gas mask while carrying or operating a weapon.

The sling is for attachment to a connection ring or the like on the weapon for attachment of the weapon to the sling of the instant invention. The sling has a body strap for surrounding at least a portion of the upper torso of a human body. The body strap has a front and in one embodiment a back section. The back section has a back strap and the front section has a front strap substantially the same width as the back strap. The ends of the front strap have attachment loops fixedly secured thereto.

A pair of shoulder straps each of which extend over one of the shoulders of the wearer of the sling. Each of the pair of shoulder straps is fixedly secured inwardly adjacent to the attachment loops on the front strap and inwardly adjacent to the length adjustment buckles on the back strap or to the distal ends of the back strap. Length adjustable buckles are attached to the ends of the back strap. Side straps with a width less than the width of the front and back straps are fixedly attached to the loops on one end and length adjustably through the length adjustable buckles on the opposite end with the distal ends of the side straps hanging free for length adjustment of the front and back straps by pulling them away from the body as required.

Adjustable shoulder pads are positioned intermediate the ends of the shoulder straps. The shoulder are adjustable for proper positioning to ensure the resting on the shoulders of various size wearers of the sling.

A weapon support strap is attached to the front strap. A quick release snap shackle is connected to the free end of the weapon support strap. The quick release snap shackle for connecting to the gun attachment ring or the like has a closed position for supporting the weapon attachment ring and an open position for releasing the weapon from the sling.

A lanyard is attached to a quick release member on the shackle and when pulled opens the shackle and releases the weapon from the sling.

A second embodiment of the invention is similar to the first embodiment except that the buckles are on the ends of the back strap and the loops are on the ends of the front strap and the weapon support strap is fixedly secured to the front.

A third embodiment is like the second embodiment except that there is no resilient back strap and in place thereof the shoulder straps are angularly attached adjacent to at their back distal ends and the back straps attach directly to the side straps.

The principal object of this invention is to provide a tactical weapon sling for holding a weapon with ease of support when not in use and enable the user to operate the weapon while attached to the sling.

Another object of this invention is to provide a tactile weapon sling that can be worn over or under body armor.

Still another object of this invention is to provide a weapon sling suitable for a wide range of different weapons.

Yet another object of this invention is to provide a weapon sling that allows operation of the weapon while wearing a gas mask.

These and other objects and features of this invention will become readily apparent with reference to the following detailed description of the three embodiment of the invention and the accompanying drawing Figures.

DETAILED DESCRIPTION OF THE FIRST PREFERRED EMBODIMENT

Figure 1:
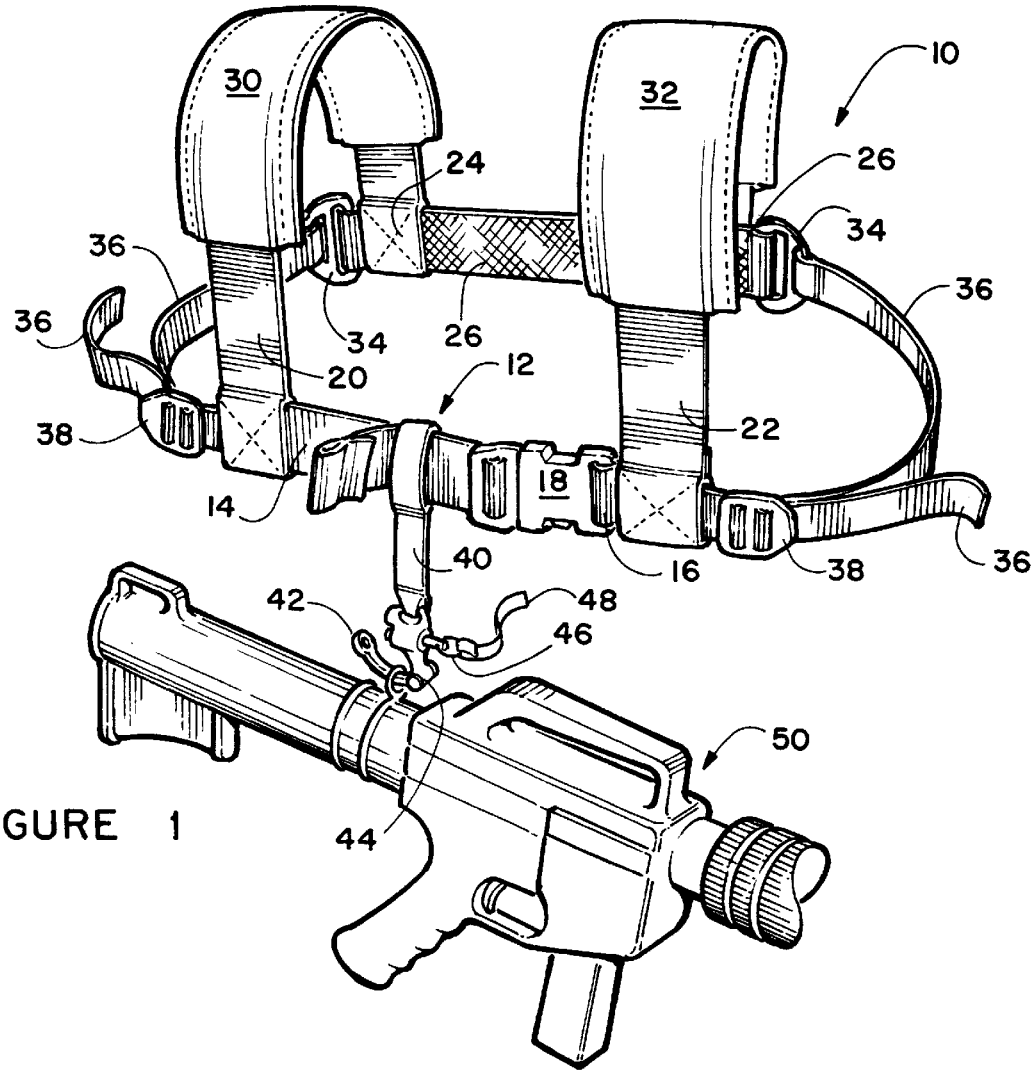
FIG. 1 depicts a first embodiment of the sling of the invention.

Referring now specifically to drawing FIG. 1, the sling 10 has a bifurcated front strap 12 having sections 14 and 16 on opposite sides of a disconnect buckle 18. The ends of the strap 12 are fixedly attached to shoulder straps 20 and 22.

The shoulder straps are fixedly attached at their opposite ends 24 and 26 respectfully to a resilient back strap 28.

The back strap is stretchable to provide a good snug fit to the back of the wearer.

Shoulder pads 30 and 32 are position able along their respective shoulder straps to provide shoulder padding for various size users of the sling 10.

At each end of the back strap 28, outboard of the shoulder strap attachment is attached a ring 34. The rings can be "D" shaped or rectangular. The free ends of the side straps 36 are releasably attached to a buckle 38 that is fixedly attached to the ends of the front straps 14, 16. The free ends of the straps passing through the buckles and can be pulled on to tighten the sling around the waist of a wearer. The buckles are of the type that allows tightening by pulling on the free ends of the side straps 36 but must be manually manipulated to release the straps.

Intermediate the strap 14 is a weapon support strap 40 that is loosely attached thereto so that it can be translated through the length of the strap 14. At the distal end of the weapon support strap is a shackle 42 with a spring loaded normally closed weapon attachment loop 44. Attached to the spring release tab 46 is a lanyard 48 which when pulled against the bias of the spring opens the loop 44 releasing the weapon 50 attached thereto.

Figure 2:
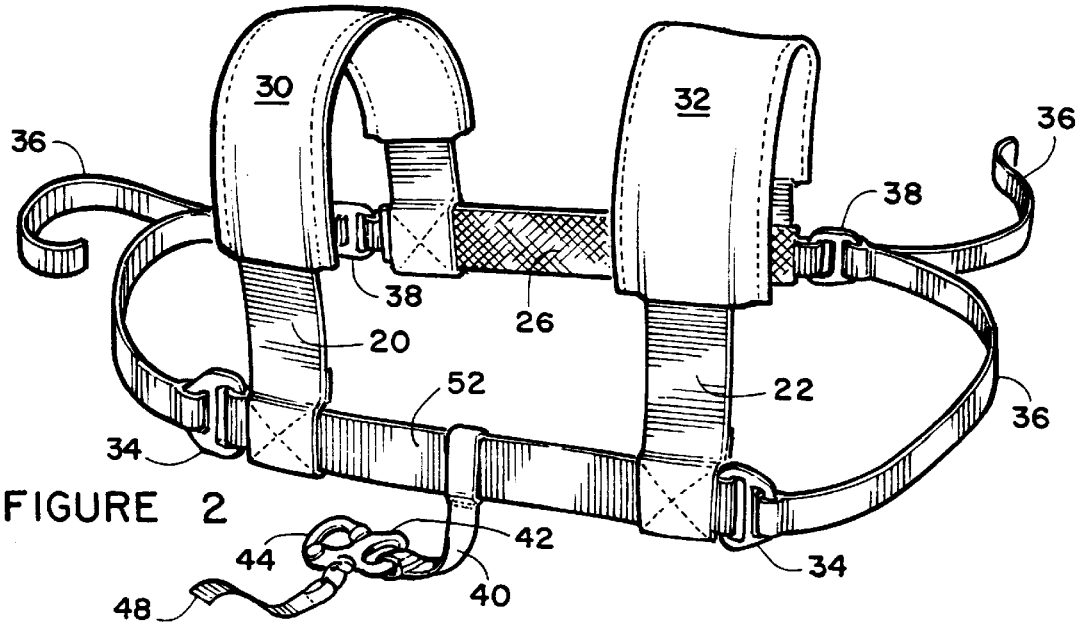
FIG. 2 depicts a second embodiment of the sling of the invention.

Referring now specifically to drawing FIG. 2, this Figure depicts a second embodiment of the invention which is similar to the showing of drawing FIG. 1 except that the buckles 38 are on the ends of the back strap 28 and the loops 34 are on the ends of the front strap 52 and the weapon support strap 40 is fixedly secured to strap 14. The rest of the sling is constructed as discussed above directed to drawing FIG. 1.

Figure 3:
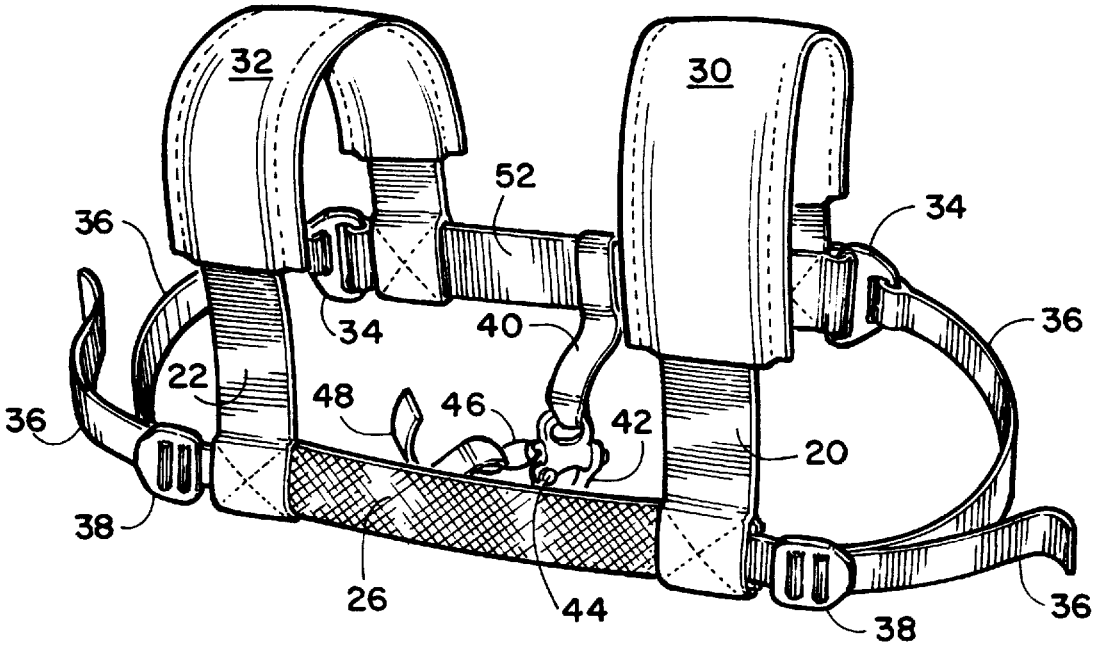
FIG. 3 is a showing of the back of the slings of FIGS. 1 and 2.

Referring now to drawing FIG. 3, this Figure is a showing of the back of the sling of FIG. 2. This showing is also similar to the back of the sling of drawing FIG. 1 except for the above noted differences.

Figure 4:
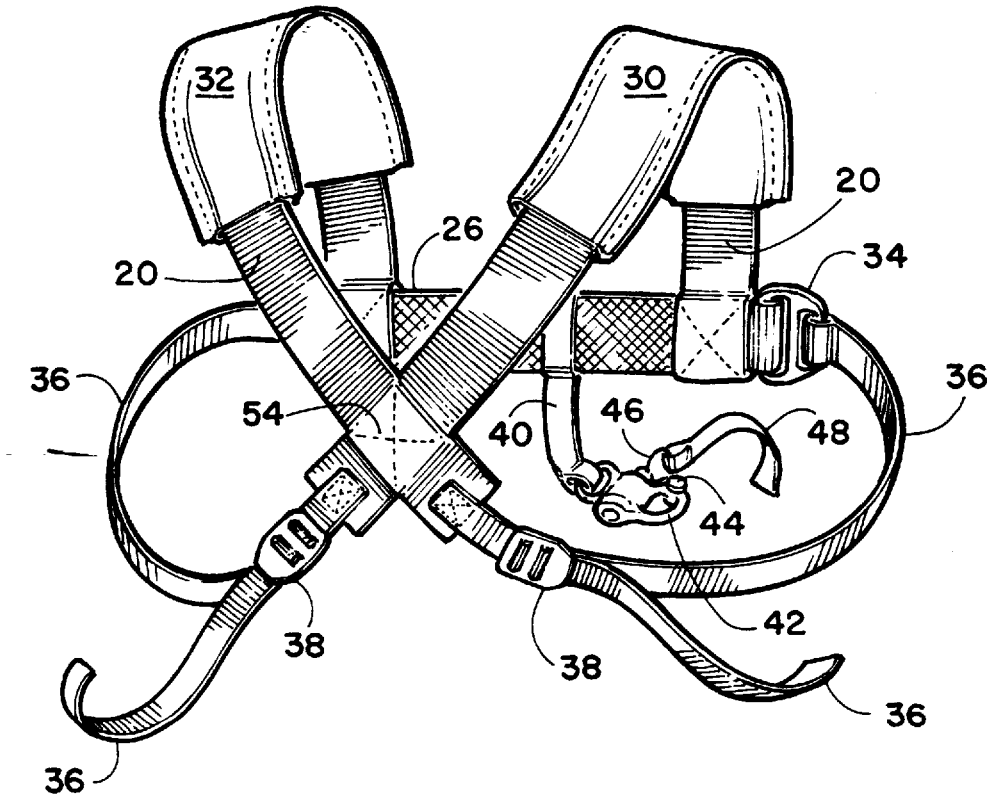
FIG. 4 depicts a third embodiment of the invention.

The embodiment of FIG. 4 is like the embodiment of FIG. 2 except that this embodiment has a resilient front strap 26 and has no back strap and in place thereof the shoulder straps 30,32 which are angularly attached adjacent to at their back distal ends at a location 54.

Having described and illustrated the principles of my invention with reference to the preferred embodiments, it should be apparent that the invention can be modified in arrangement and detail without departing from the principles. Accordingly, I claim all modifications as may come within the scope and sprit of the following claims.

I claim:

1. A sling for a tactical weapon, said weapon having a sling connection means comprising:

a body strap surrounding the upper torso of a human body, said body strap having a front and back section, said back section having a back strap, said front section having a front strap substantially the same width as said back strap;

the distal ends of said front strap having attachment loops fixedly secured thereto;

length adjustable buckles attached to the distal ends of said back strap;

a pair of shoulder straps each of which extend over one of the shoulders of the wearer of the sling, each of said pair of shoulder straps being fixedly secured inward from and inwardly adjacent to said attachment loops on said front strap and inwardly adjacent to said length adjustment buckles on said back strap;

side straps having a width less than the width of said front and back straps fixedly attached to said loops on one end and adjustably through said length adjustable buckles on the opposite end with their distal ends hanging free;

a shoulder pad intermediate the ends of said shoulder straps for resting on the shoulders of the wearer;

a weapon support strap carried by said front strap;

a quick release snap shackle fixedly connected to the free end of said weapon support strap, said quick release snap shackle has a loop for connecting to said gun attachment means, said shackle having a closed position for supporting said weapon and an open position for releasing said weapon; and a lanyard attached to a quick release means on said shackle when said lanyard is pulled said gun is released from said sling.

2. The invention as defined in claim 1 wherein said back strap is resilient.

3. The invention as defined in claim 1 wherein said weapon support strap is slidably attached to said front strap.

4. The invention as defined in claim 1 wherein said weapon support strap is fixedly attached to said front strap.

5. The invention as defined in claim 1 wherein said shoulder pads are position adjustable along said straps.

6. The invention as defined in claim 1 wherein said front strap has a buckle disconnect intermediate the ends of said strap.

7. The invention as defined in claim 1 wherein the free ends of said side straps when pulled adjusts said front and back straps to together to fit the wearer.

8. The invention as defined in claim 1 wherein said shoulder straps are crossed in the back before attaching to said side straps.

9. A sling for a tactical weapon having an attachment means comprising:

a body strap across the front upper torso of a human body;

the distal ends of said body strap having attachment loops fixedly secured thereto;

a pair of shoulder straps each of which extend over one of the shoulders of the wearer of the sling, each of said pair of shoulder straps being fixedly secured inward from and inwardly adjacent to said attachment loops on said front strap and inwardly adjacent to said length adjustment buckles on said back strap;

length adjustable buckles attached to the distal ends of said shoulder straps;

side straps having a width less than the width of said front and back straps fixedly attached to said loops on one end and adjustably through said length adjustable buckles on the opposite end with their distal ends hanging free;

a shoulder pad intermediate the ends of said shoulder straps for resting on the shoulders of the wearer;

a weapon support strap attached to said front strap;

a quick release snap shackle connected to the free end of said weapon support strap, said quick release snap shackle having a closed position for supporting a weapon and an open position for releasing said weapon; and a lanyard attached to a quick release means on said shackle when said lanyard is pulled said weapon is released from said sling.

10. The invention as defined in claim 9 wherein said shoulder pads are position adjustable along said straps.

11. The invention as defined in claim 9 wherein said front strap has a buckle disconnect intermediate the ends of said strap.

12. The invention as defined in claim 9 wherein said shoulder straps are crossed in the back before attaching to said side straps.

13. A sling for a tactical weapon, said weapon having a sling connection means comprising:

a resilient front strap surrounding the front of the upper torso of a human body;

the distal ends of said front strap having attachment loops fixedly secured thereto;

a pair of shoulder straps each of which extend over one of the shoulders of the wearer of the sling, each of said pair of shoulder straps being fixedly secured inward from and inwardly adjacent to said attachment loops on said front strap, said shoulder straps are fixedly attached at their cross over;

length adjustable buckles attached to the distal ends of each of said shoulder straps;

side straps having a width less than the width of said front strap fixedly attached to said loops on one end and adjustably through said length adjustable buckles on the opposite end with their distal ends hanging free;

a shoulder pad intermediate the ends of said shoulder straps for resting on the shoulders of the wearer;

a weapon support strap attached to said front strap;

a quick release snap shackle connected to the free end of said weapon support strap, said quick release snap shackle for connecting to said gun attachment means, said shackle having a closed position for supporting said weapon and an open position for releasing said weapon; and a lanyard attached to a quick release means on said shackle when said lanyard is pulled said gun is released from said sling.

14. The invention as defined in claim 13 wherein said weapon support strap is slidably attached to said front strap.

15. The invention as defined in claim 13 wherein said weapon support strap is fixedly attached to said front strap.

16. The invention as defined in claim 13 wherein said shoulder pads are position adjustable along said straps.

17. The invention as defined in claim 13 wherein said front strap has a buckle disconnect intermediate the ends of said strap.

18. The invention as defined in claim 13 wherein the free ends of said side straps when pulled adjusts said front and back straps to together to fit the wearer.

19. The invention as defined in claim 13 wherein said shoulder straps are crossed in the back before attaching to said side straps.

* * * * *